US010714005B2

(12) United States Patent
Ling et al.

(10) Patent No.: US 10,714,005 B2
(45) Date of Patent: Jul. 14, 2020

(54) PIXEL COMPENSATION CIRCUIT AND METHOD OF DRIVING THE SAME, DISPLAY PANEL, AND DISPLAY DEVICE

(71) Applicants: BOE TECHNOLOGY GROUP CO., LTD., Beijing (CN); HEFEI BOE OPTOELECTRONICS TECHNOLOGY CO., LTD., Hefei, Anhui (CN)

(72) Inventors: Jie Ling, Beijing (CN); Wenjian Wang, Beijing (CN); Douqing Zhang, Beijing (CN)

(73) Assignees: BOE TECHNOLOGY GROUP CO., LTD., Beijing (CN); HEFEI BOE OPTOELECTRONICS TECHNOLOGY CO., LTD., Hefei, Anhui (CN)

( * ) Notice: Subject to any disclaimer, the term of this patent is extended or adjusted under 35 U.S.C. 154(b) by 87 days.

(21) Appl. No.: 16/048,861

(22) Filed: Jul. 30, 2018

(65) Prior Publication Data

US 2019/0164483 A1 May 30, 2019

(30) Foreign Application Priority Data

Nov. 27, 2017 (CN) ..... 2017 1 1206365

(51) Int. Cl.
*G09G 3/30* (2006.01)
*G09G 3/3233* (2016.01)

(52) U.S. Cl.
CPC ... *G09G 3/3233* (2013.01); *G09G 2300/0852* (2013.01); *G09G 2300/0861* (2013.01);
(Continued)

(58) Field of Classification Search
CPC .. G09G 3/3233; G09G 3/3258; G09G 3/3266; G09G 2320/045; G09G 2320/043;
(Continued)

(56) References Cited

U.S. PATENT DOCUMENTS 8,823,613 B2 9/2014 Chung et al.
2016/0125808 A1* 5/2016 Hsu ..... G09G 3/3233 345/212
(Continued)

FOREIGN PATENT DOCUMENTS

CN 104157240 A 11/2014
CN 204029330 U 12/2014
(Continued)

OTHER PUBLICATIONS

First Office Action for CN Application No. 201711206365.X dated Apr. 22, 2019.

*Primary Examiner* — Jennifer T Nguyen
(74) *Attorney, Agent, or Firm* — Foley & Lardner LLP

(57) ABSTRACT

The present disclosure relates to a pixel compensation circuit and a method of driving the same, a display panel, and a display device. A pixel compensation circuit includes: a control sub-circuit, a write sub-circuit, a driving sub-circuit, and a light emitting sub-circuit, wherein the write sub-circuit is configured to, under the control of a scan signal terminal, transmit a data signal at a data signal terminal to the control sub-circuit and transmit a signal at a reference voltage signal terminal to the control sub-circuit; the control sub-circuit is configured to, under the control of a power control signal terminal, transmit a signal at a first power terminal to the driving sub-circuit, and under the combined action of a conduction control signal terminal and the power control signal terminal, control the driving sub-circuit to perform threshold compensation, and control the
(Continued)

driving sub-circuit to generate a driving current to drive the light emitting sub-circuit to emit light.

13 Claims, 8 Drawing Sheets

(52) U.S. Cl.
CPC ..... *G09G 2310/0251* (2013.01); *G09G 2310/0262* (2013.01); *G09G 2320/0233* (2013.01); *G09G 2320/043* (2013.01); *G09G 2330/021* (2013.01)

(58) Field of Classification Search
CPC ..... G09G 2300/0819; G09G 2310/062; G09G 2310/0264; H01L 27/3276; H01L 27/3248
USPC ..... 345/76, 78, 690
See application file for complete search history.

(56) References Cited

U.S. PATENT DOCUMENTS

| | | | | |
|---|---|---|---|---|
| 2016/0240565 | A1* | 8/2016 | Kim | H01L 29/78606 |
| 2017/0330511 | A1 | 11/2017 | Feng | |
| 2019/0035330 | A1* | 1/2019 | Li | H01L 27/3276 |
| 2019/0108789 | A1* | 4/2019 | Tsuge | G09G 3/3233 |

FOREIGN PATENT DOCUMENTS

| | | | |
|---|---|---|---|
| CN | 204614415 | U | 9/2015 |
| CN | 107195274 | A | 9/2017 |
| CN | 107301839 | A | 10/2017 |

* cited by examiner

PIXEL COMPENSATION CIRCUIT AND METHOD OF DRIVING THE SAME, DISPLAY PANEL, AND DISPLAY DEVICE

CROSS-REFERENCE TO RELATED APPLICATIONS

The present application claims priority to Chinese Application No. 201711206365.X filed on Nov. 27, 2017, the disclosure of which is hereby incorporated by reference in its entirety.

FIELD

The present disclosure relates to the field of display technology.

BACKGROUND

Organic Light-Emitting Diode (OLED) is one of the hotspots in current flat panel display researches. Compared with Liquid Crystal Display (LCD), OLED has advantages such as fast response, high brightness, high contrast, low power consumption, easy for the implementation of flexible display etc, and is considered to be the next generation of mainstream displays.

SUMMARY

According to an aspect of the present disclosure, a pixel compensation circuit is provided, including: a control sub-circuit, a write sub-circuit, a driving sub-circuit, and a light emitting sub-circuit, wherein the write sub-circuit is configured to, under the control of a scan signal terminal, transmit a data signal at a data signal terminal to the driving sub-circuit and transmit a signal at a reference voltage signal terminal to the control sub-circuit; the control sub-circuit is configured to, under the control of a power control signal terminal, transmit a signal at a first power terminal to the driving sub-circuit, and under the combined action of a conduction control signal terminal and the power control signal terminal, control the driving sub-circuit to perform threshold compensation, and control the driving sub-circuit to generate a driving current to drive the light emitting sub-circuit to emit light.

In some embodiments according to the present disclosure, the pixel compensation circuit further comprises a reset sub-circuit configured to, under the control of a reverse bias control signal terminal, transmit a signal at the reverse bias voltage signal terminal to the light emitting sub-circuit.

In some embodiments according to the present disclosure, the control sub-circuit further comprises: a first switching transistor, a second switching transistor, and a first capacitor; a control electrode of the first switching transistor is connected to the power control signal terminal, a first electrode of the first switching transistor is connected to the first power terminal, and a second electrode of the first switching transistor is connected to a first end of the first capacitor and the driving sub-circuit respectively; a control electrode of the second switching transistor is connected to the conduction control signal terminal, a first electrode of the second switching transistor is connected to a second end of the first capacitor and the write sub-circuit respectively, a second electrode of the second switching transistor is connected to the driving sub-circuit.

In some embodiments according to the present disclosure, the write sub-circuit comprises: a third switching transistor and a fourth switching transistor; a control electrode of the third switching transistor is connected to the scan signal terminal, a first electrode of the third switching transistor is connected to the data signal terminal, and a second electrode of the third switching transistor is connected to the driving sub-circuit; a control electrode of the fourth switching transistor is connected to the scan signal terminal, a first electrode of the fourth switching transistor is connected to the reference voltage signal terminal, and a second electrode of the fourth switching transistor is connected to the control sub-circuit.

In some embodiments according to the present disclosure, the reset sub-circuit comprises: a fifth switching transistor and a second capacitor; a control electrode of the fifth switching transistor is connected to the reverse bias control signal terminal, a first electrode of the fifth switching transistor is connected to the reverse bias voltage signal terminal, and a second electrode of the fifth switching transistor is connected to the light emitting sub-circuit and a first end of the second capacitor; a second end of the second capacitor is connected to a second power terminal, the light emitting sub-circuit is connected to the second power terminal.

In some embodiments according to the present disclosure, the reverse bias control signal terminal and the reverse bias voltage signal terminal are the same signal terminal.

In some embodiments according to the present disclosure, the fifth switching transistor is a P-type transistor.

In some embodiments according to the present disclosure, a signal voltage at the reverse bias voltage signal terminal is smaller than a signal voltage at the second power terminal at least during a period in which the fifth switching transistor is turned on.

In some embodiments according to the present disclosure, the driving sub-circuit comprises: a driving transistor; wherein a control electrode of the driving transistor is connected to the control sub-circuit and the write sub-circuit respectively, a first electrode of the driving transistor is connected to the control sub-circuit, and a second electrode of the driving transistor is connected to the light emitting sub-circuit; the light emitting sub-circuit comprises: an electroluminescent device; wherein an anode of the electroluminescent device is connected to the driving sub-circuit, and a cathode of the electroluminescent device is connected to the second power terminal.

In some embodiments according to the present disclosure, the driving transistor is a P-type transistor.

In some embodiments according to the present disclosure, the electroluminescent device is an organic light emitting diode or a quantum dot light emitting diode.

In some embodiments according to the present disclosure, the conduction control signal terminal and the scan signal terminal are the same signal terminal.

In some embodiments according to the present disclosure, the reference voltage signal terminal and the second power terminal are the same signal terminal.

According to another aspect of the present disclosure, a display panel is provided, comprising the pixel compensation circuit of the present disclosure.

According to another aspect of the present disclosure, a display device is provided, comprising the display panel of the present disclosure.

According to another aspect of the present disclosure, a method for driving a pixel compensation circuit is provided, including: in a reset stage, a write sub-circuit transmitting, under the control of a scan signal terminal, a data signal at a data signal terminal to a driving sub-circuit, and transmitting a signal at the reference voltage signal terminal to the control sub-circuit; in a threshold compensation stage, the write sub-circuit transmitting, under the control of the scan signal terminal, the data signal at the data signal terminal to the driving sub-circuit, and transmitting the signal at the reference voltage signal terminal to the control sub-circuit; the control sub-circuit controlling, under the combined action of the conduction control signal is terminal and the power control signal terminal, the driving sub-circuit to perform threshold compensation; and in a light emitting stage, the control sub-circuit controlling, under the combined action of the conduction control signal terminal and the power control signal terminal, the driving sub-circuit to generate a driving current to drive the light emitting sub-circuit to emit light and display.

In some embodiments of the present disclosure, in the reset stage, the reset sub-circuit transmits, under the control of the reverse bias control signal terminal, a signal at the reverse bias voltage signal terminal to the light emitting sub-circuit, so that the light emitting sub-circuit is controlled to be in a reverse bias state.

DETAILED DESCRIPTIONS

In order to make the objectives, technical schemes and advantages of the present invention more clear, specific embodiments of the pixel compensation circuit, the driving method thereof, the display panel, and the display device provided by the embodiments of the present disclosure are described in detail below with reference to the accompanying drawings. It should be noticed that preferred embodiments described herein are merely used for explaining the present disclosure, but not limitation to the disclosure. In the case of no conflict, the embodiments and the features of the embodiments of the present disclosure may be combined with each other.

Different from LCDs that use a stable voltage to control brightness, OLEDs are current-driven devices and require a constant current to control light emitting. Currently, a pixel compensation circuit that can compensate for a threshold voltage $V_{th}$ of a driving transistor is generally provided in an OLED display to drive the OLED to emit light, wherein charging is performed by writing a data signal to the pixel compensation circuit to compensate for the threshold voltage $V_{th}$ of the driving transistor. However, the inventors of the present disclosure discovers that when the written data signal is a low gray scale data signal, the charging current of the low gray scale data signal is small, and results in longer charging time, thereby causing a problem of insufficient threshold compensation, which in turn affects the brightness of the OLED.

Figure 1:
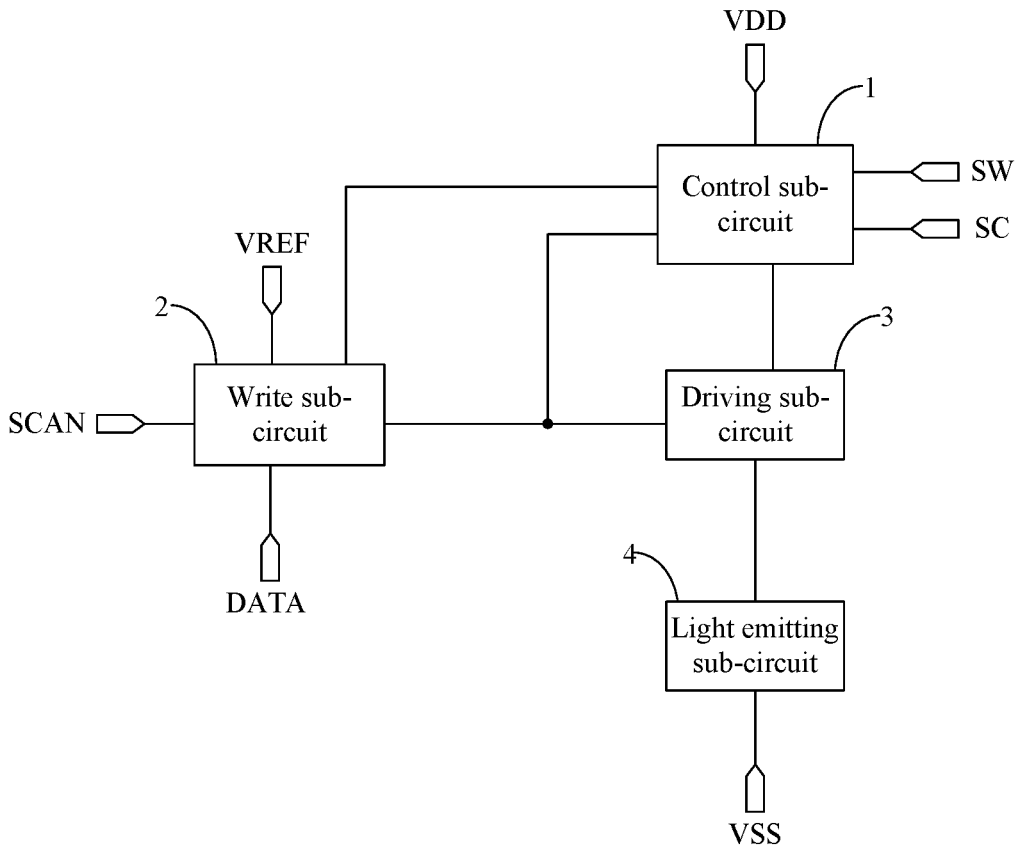
FIG. 1 is a schematic structural diagram of a pixel compensation circuit according to an embodiment of the present disclosure.

A pixel compensation circuit is provided according to an embodiment of the present disclosure, as shown in FIG. 1, including: a control sub-circuit 1, a write sub-circuit 2, a driving sub-circuit 3, and a light emitting sub-circuit 4, wherein:

the write sub-circuit 2 is respectively connected to the scan signal terminal SCAN, the data signal terminal DATA, the reference voltage signal terminal VREF, the control sub-circuit 1 and the driving sub-circuit 3 for transmitting a signal at the data signal terminal DATA to the driving sub-circuit 3 and transmitting a signal at the reference voltage signal terminal VREF to the control sub-circuit 1 respectively, under the control of the scan signal terminal SCAN;

the control sub-circuit 1 is further connected to a conduction control signal terminal SC, a power control signal terminal SW, the first power terminal VDD and the driving sub-circuit 3 for transmitting, under the control of the power control signal terminal SW, a signal at the first power terminal VDD to the driving sub-circuit 3; controlling the driving sub-circuit 3 to perform threshold compensation and controlling the driving sub-circuit 3 to generate a driving current, under the combined action of the conduction control signal terminal SC and the power control signal terminal SW;

a reset sub-circuit 5 is connected to a reverse bias control signal terminal SN, a reverse bias voltage signal terminal VI, a second power terminal VSS, and a light emitting sub-circuit 4 for transmitting, under the control of the reverse bias control signal terminal SN, a signal at the reverse bias voltage signal terminal VI to the light emitting sub-circuit 4;

the driving sub-circuit 3 is further connected to the light emitting sub-circuit 4, and the light emitting sub-circuit 4 is further connected to the second power terminal VSS; the driving sub-circuit 3 is used for generating a driving current and transmitting the driving current to the light emitting sub-circuit 4 to drive the light emitting sub-circuit 4 to emit light and display.

The pixel compensation circuit provided according to an embodiment of the present disclosure comprises: a control sub-circuit 1, a write sub-circuit 2, a driving sub-circuit 3, and a light emitting sub-circuit 4, wherein, the write sub-circuit 2, under the control of the scan signal terminal SCAN, transmits a data signal at the data signal terminal DATA to the driving sub-circuit 3, and transmits a signal at the reference voltage signal terminal VREF to the control sub-circuit 1; and the control signal terminal 1 transmits a signal at the first power terminal VDD to the driving sub-circuit 3 under the control of the power control signal terminal SW; and the control sub-circuit 1 controls the driving sub-circuit 3 to discharge and perform threshold compensation under the combined action of the conduction control signal terminal SC and the power control signal terminal SW, to write a threshold voltage of a driving transistor to the driving sub-circuit 3. Thus, through charging the pixel compensation circuit by the signal at the first power terminal VDD, the function of quickly writing the threshold voltage of the driving transistor can be realized, so that the pixel compensation circuit is enabled to perform fast threshold voltage compensation and reduce charging time for the compensation, thereby further improving stability of light emitting and display.

According to some embodiments of the present disclosure, in the above pixel compensation circuit, the voltage of the signal at the second power terminal VSS is generally a low voltage or a ground voltage, and the voltage of the signal at the first power terminal VDD is generally a high voltage. In a practical application, the voltage of the signal at the second power terminal VSS and the voltage of the signal at the first power terminal VDD need to be determined according to the actual application environments, which is not limited herein.

Figure 6:
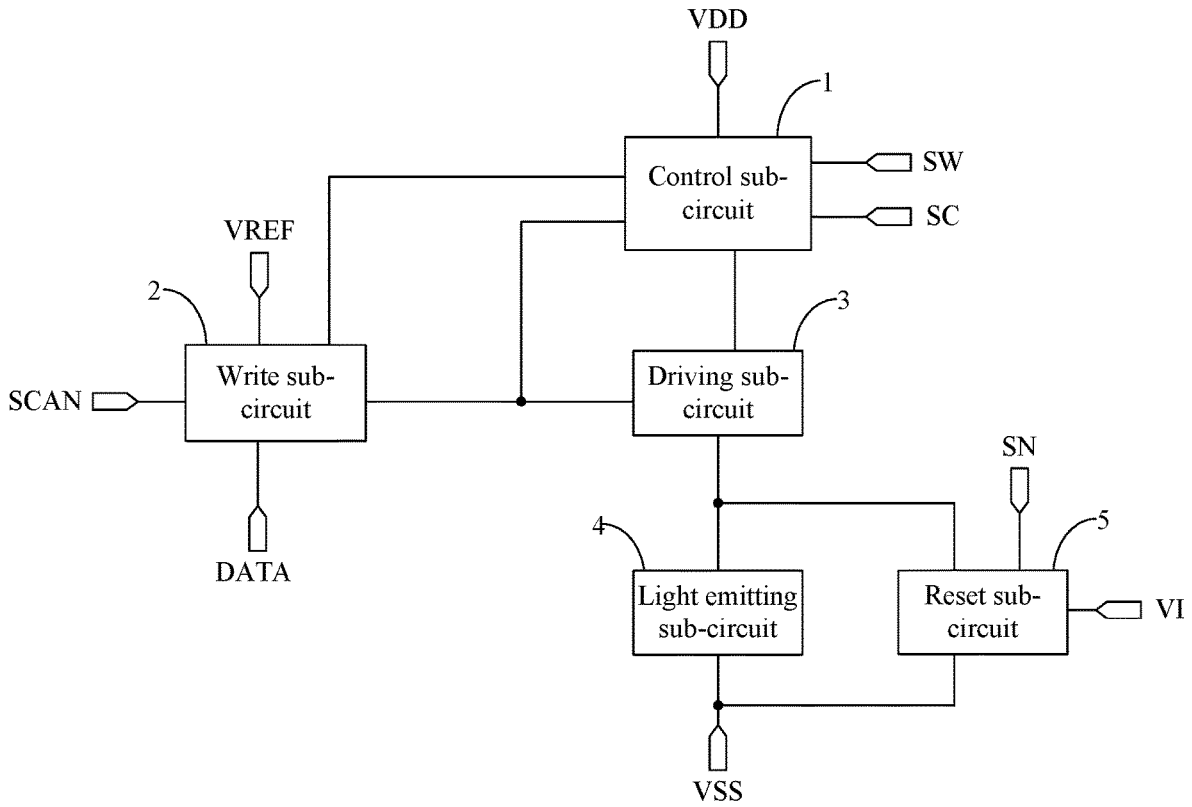
FIG. 6 is a schematic structural diagram of the pixel compensation circuit according to an embodiment of the present disclosure.

FIG. 6 shows a schematic diagram of a pixel compensation circuit in accordance with another embodiment of the present disclosure. Compared with FIG. 1, the pixel compensation circuit shown in FIG. 6 further includes a reset sub-circuit 5. The reset sub-circuit 5 transmits a signal at the reverse bias voltage signal terminal VI to the light emitting sub-circuit 4 under the control of the reverse bias control signal terminal SN, the light emitting sub-circuit 4 is reset and the light emitting sub-circuit 4 is controlled to be in a reverse bias state, which may further improve a problem of reduced performance and lifetime of the light emitting sub-circuit 4 due to the loss caused by long time forward biasing.

The present disclosure will be described in detail below in conjunction with a specific embodiment. It should be noted that the embodiment is intended to better explain the present disclosure, but is not a limitation on the disclosure.

According to some embodiments of the present disclosure, in the pixel compensation circuit, as shown in FIGS. 2*a* to 3*b*, the light emitting sub-circuit 4 may include: an electroluminescent device L; wherein an anode of the electroluminescent device L is connected to the driving sub-circuit 3 and the reset sub-circuit 5 respectively, and a cathode of the electroluminescent device L is connected to the second power terminal VSS.

In the pixel compensation circuit of some embodiments according to the present disclosure, the electroluminescent device may be an organic light emitting diode, or the light emitting device may be a quantum dot light emitting diode. In a practical application, the specific structure of the electroluminescent device needs to be determined according to the actual application environments, which is not limited herein.

In the pixel compensation circuit of some embodiments according to the present disclosure, as shown in FIGS. 2*a* to 3*b*, the control sub-circuit 3 may include: a driving transistor M0; wherein, a control electrode of the driving transistor M0 is connected to the control sub-circuit 1 and the write sub-circuit 2 respectively, a first electrode of the driving transistor M0 is connected to the control sub-circuit 1, and a second electrode of the driving transistor M0 is connected to the light emitting sub-circuit 4. Specifically, the second electrode of the driving transistor M0 is connected to the anode of the electroluminescent device L in the light emitting sub-circuit 4.

In the pixel compensation circuit of some embodiments according to the present disclosure, as shown in FIGS. 2*a* to 3*b*, the driving transistor M0 may be a P-type transistor; in this case, the control electrode of the driving transistor M0 is its gate electrode, the first electrode of the driving transistor M0 is its source electrode, and the second electrode of the driving transistor M0 is its drain electrode. Further, a driving current of the driving transistor M0 for driving the electroluminescent device L in the driving sub-circuit 4 to emit light is generated by the control of a voltage difference between the gate electrode and the source electrode of the driving transistor M0, and flows from the source electrode to the drain electrode. Further, if the driving transistor M0 is a P-type transistor, its threshold voltage $V_{th}$ is a negative value.

In the pixel compensation circuit of some embodiments according to the present disclosure, as shown in FIGS. 2*a* to 3*b*, the write sub-circuit 2 may include: a third switching transistor M3 and a fourth switching transistor M4;

a control electrode of the third switching transistor M3 is connected to the scan signal terminal SCAN, a first electrode of the third switching transistor M3 is connected to the data signal terminal DATA, and a second electrode of the third switching transistor M3 is connected to the driving sub-circuit 3. Particularly, the second electrode of the third switching transistor M3 is connected to the control electrode of the driving transistor M0.

A control electrode of the fourth switching transistor M4 is connected to the scan signal terminal SCAN, a first electrode of the fourth switching transistor M4 is connected to the reference voltage signal terminal VREF, and a second electrode of the fourth switching transistor M4 is connected to the control sub-circuit 1. Specifically, the second electrode of the fourth switching transistor M4 is connected to a second end of a storage capacitor Cst (i.e., a first capacitor) in the control sub-circuit 1.

In the pixel compensation circuit of some embodiments according to the present disclosure, as shown in FIGS. 2*a* to 3*a*, the third switching transistor M3 and the fourth switching transistor M4 may be P-type transistors. Alternatively, as shown in FIG. 3*b*, the third switching transistor M3 and the fourth switching transistor M4 may also be N-type transistors, which is not limited herein.

In the pixel compensation circuit according to some embodiments of the present disclosure, when the third switching transistor M3 is in an ON state under the control of a signal at the scan signal terminal SCAN, a data signal at the data signal terminal DATA may be transmitted to the control electrode of the driving transistor M0 in the driving sub-circuit 3. When the fourth switching transistor M4 is in an ON state under the control of the signal at the scan signal terminal SCAN, a signal at the reference voltage signal terminal VREF can be transmitted to the storage capacitor Cst in the control sub-circuit 1.

Figure 3A:
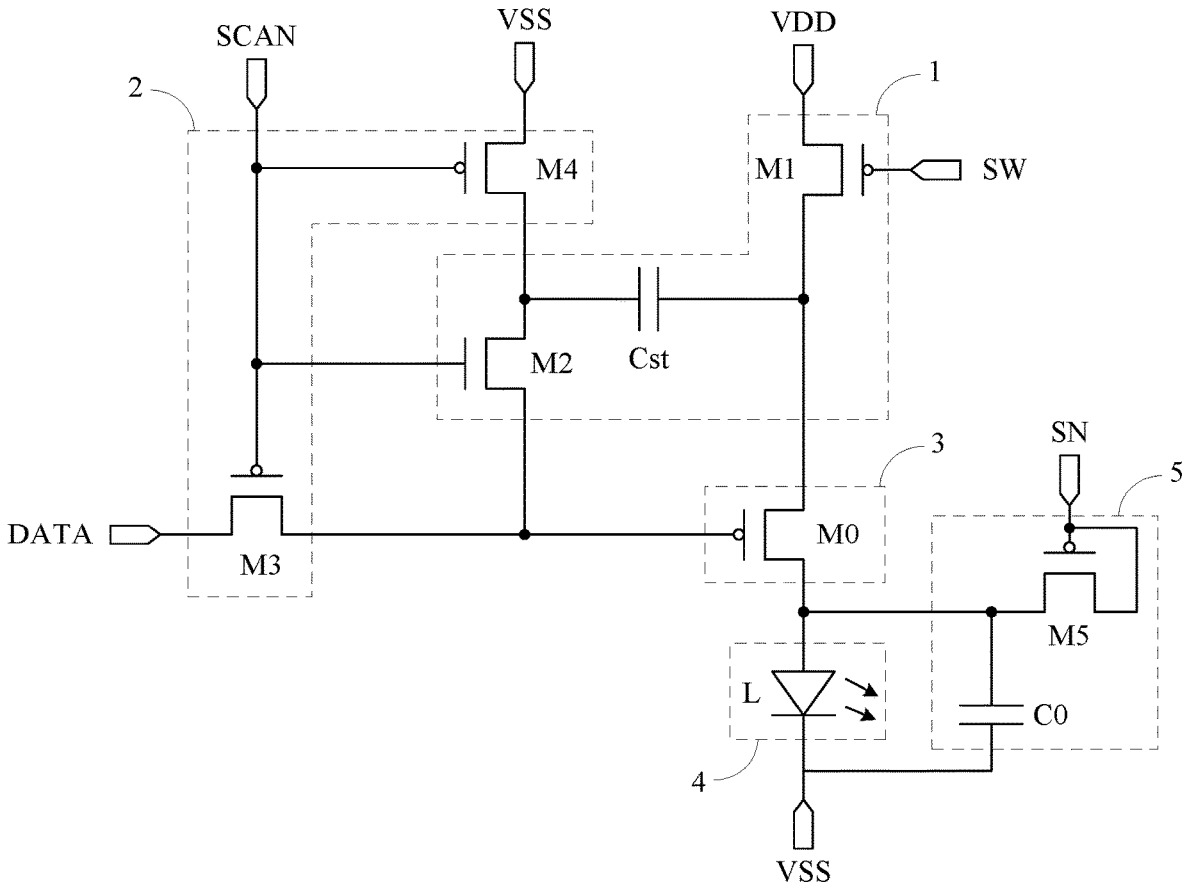
FIG. 3*a* is a schematic diagram showing the specific structure of a pixel compensation circuit according to an embodiment of the present disclosure.
Figure 3B:
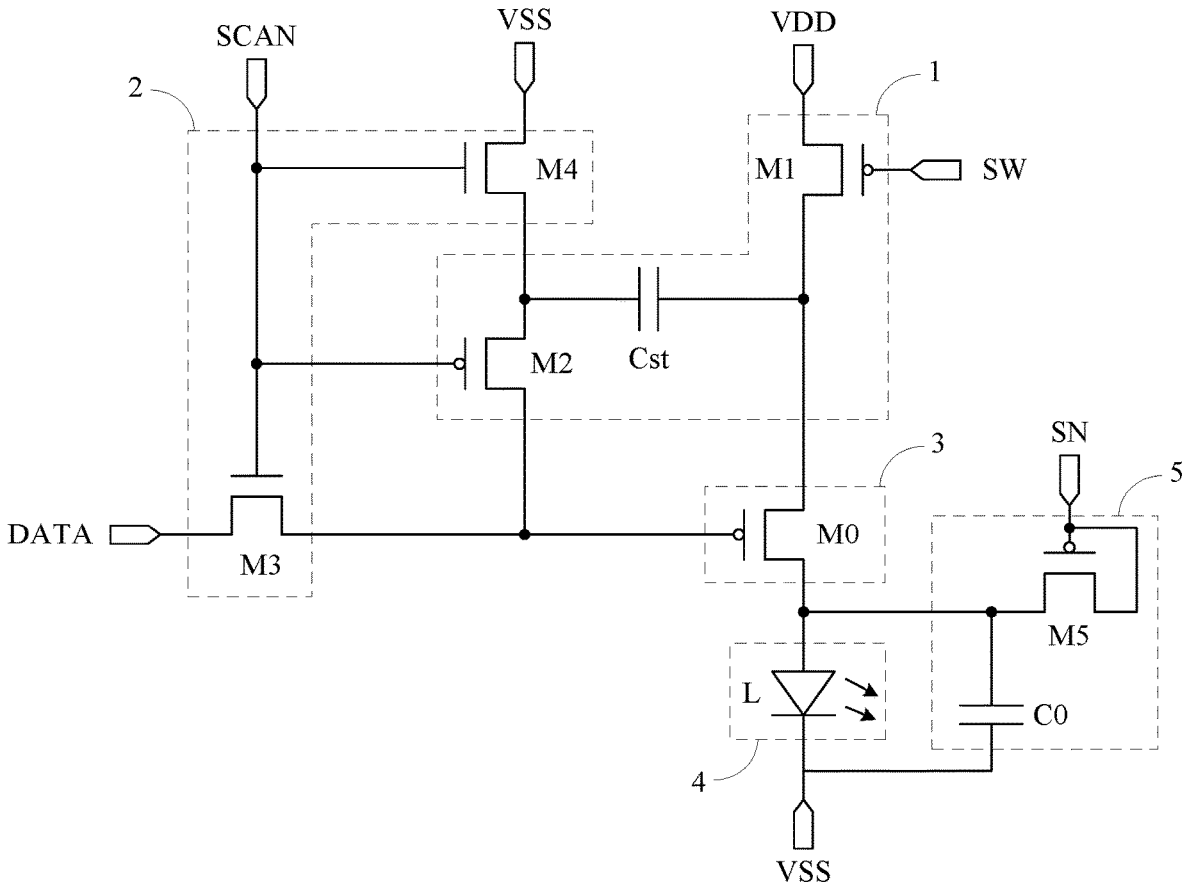
FIG. 3*b* is a schematic diagram showing the specific structure of a pixel compensation circuit according to an embodiment of the present disclosure.

In order to reduce signal terminals, lower the difficulty of signal transmission wiring and reduce the occupied space, in the pixel compensation circuit according to some embodiments of the present disclosure, the reference voltage signal terminal VREF and the second power terminal VSS may be the same signal terminal. Specifically, as shown in FIG. 3*a* and FIG. 3*b*, the first electrode of the fourth switching transistor M4 is connected to the second power terminal VSS.

In the pixel compensation circuit of some embodiments according to the present disclosure, as shown in FIGS. 2*a* to 3*b*, the control sub-circuit 1 may include: a first switching transistor M1, a second switching transistor M2, and a storage capacitor Cst.

A control electrode of the first switching transistor M1 is connected to the power control signal terminal SW, a first electrode of the first switching transistor M1 is connected to the first power terminal VDD, and a second electrode of the first switching transistor M1 is connected to a first end of the storage capacitor Cst and the driving sub-circuit 3 respectively. Specifically, the second electrode of the first switching transistor M1 is connected to the first end of the storage capacitor Cst and the first electrode of the driving transistor M0 in the driving sub-circuit 3 respectively.

A control electrode of the second switching transistor M2 is connected to the conduction control signal terminal SC, a first electrode of the second switching transistor M2 is connected to a second end of the storage capacitor Cst and the write sub-circuit 2 respectively, a second electrode of the second switching transistor M2 is connected to the driving sub-circuit 3. Specifically, the first electrode of the second switching transistor M2 is connected to the second end of the storage capacitor Cst and the second electrode of the fourth driving transistor M4 in the write sub-circuit 2 respectively, the second electrode of the second switching transistor M2 is connected to the control electrode of the driving transistor M0 in the driving sub-circuit 3.

In the pixel compensation circuit of some embodiments according to the present disclosure, as shown in FIGS. 2*a* to 3*b*, the first switching transistor M1 may be a P-type transistor. Alternatively, the first switching transistor may also be a N-type transistor.

Figure 2A:
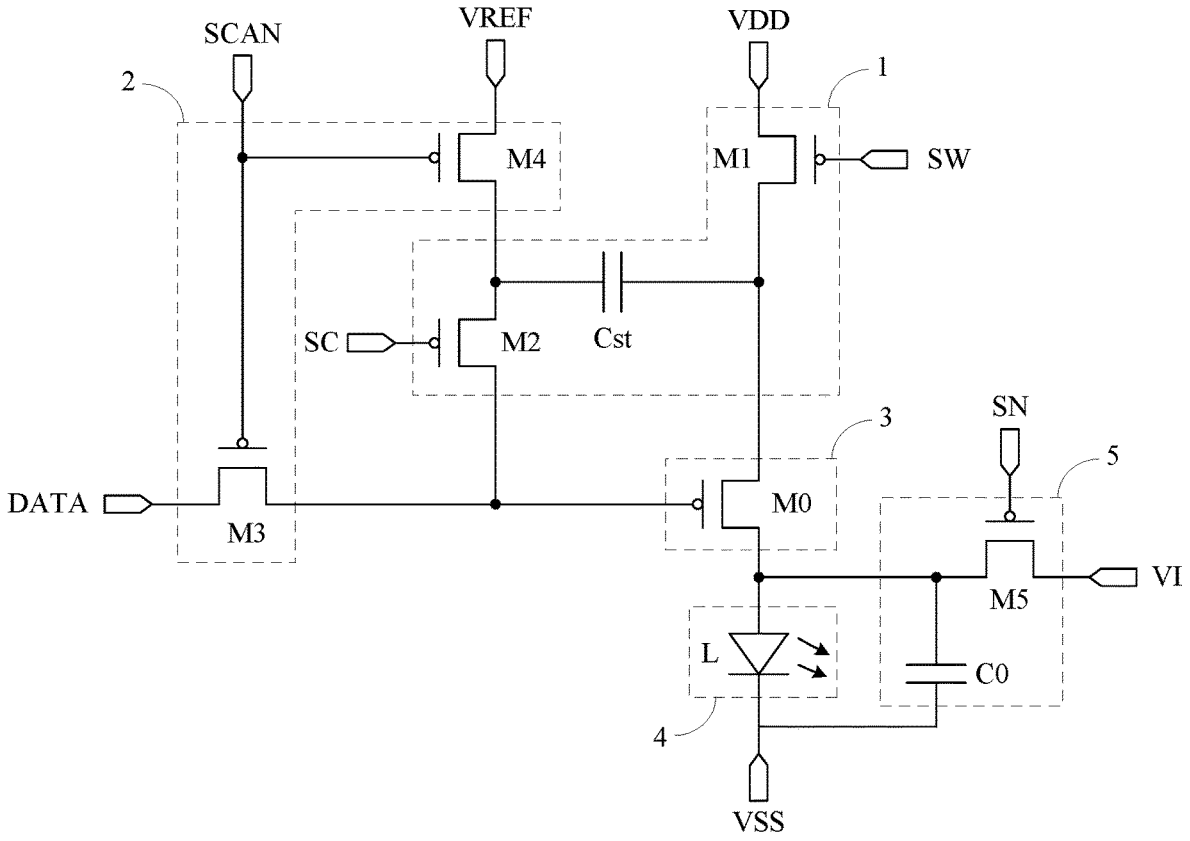
FIG. 2*a* is a schematic diagram showing the specific structure of a pixel compensation circuit according to an embodiment of the present disclosure.
Figure 2B:
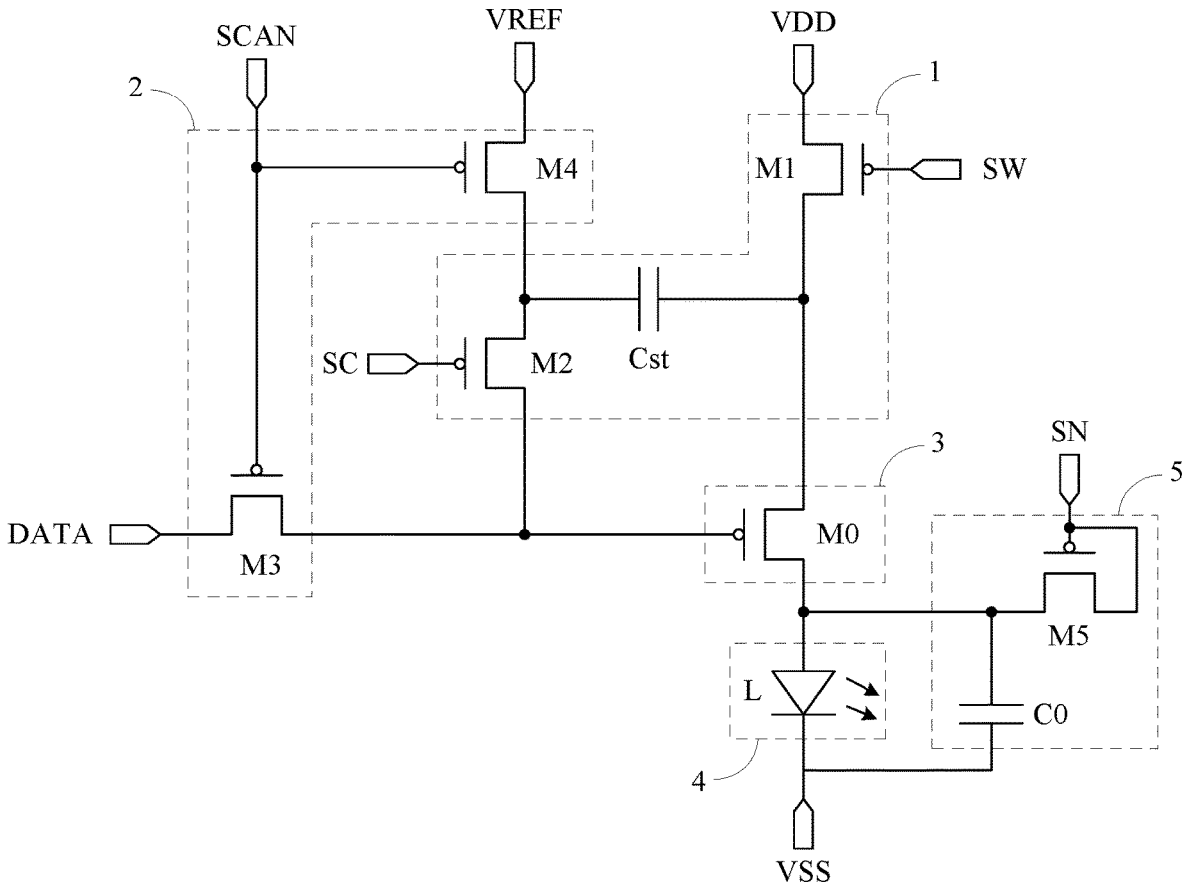
FIG. 2*b* is a schematic diagram showing the specific structure of a pixel compensation circuit according to an embodiment of the present disclosure.

In the pixel compensation circuit of some embodiments according to the present disclosure, as shown in FIGS. 2*a*, 2*b* and 3*b*, the second switching transistor M2 may be a P-type transistor. Alternatively, as shown in FIG. 3*a*, the second switching transistor M2 may also be an N-type transistor, which is not limited herein.

In the pixel compensation circuit according to some embodiments of the present disclosure, when the first switching transistor M1 is in an ON state under the control of a signal at the power control signal terminal SW, a signal at the first power terminal VDD can be transmitted to the first electrode of the driving transistor M0 and the storage capacitor Cst to charge the storage capacitor Cst. When the second switching transistor M2 is in an ON state under the control of a signal at the conduction control signal terminal SC, the control electrode of the driving transistor M0 can be connected to the second end of the storage capacitor Cst, so that a signal stored in the storage capacitor Cst is transmitted to the control electrode of the driving transistor M0. The storage capacitor Cst can be charged under the action of the signal transmitted from the fourth switching transistor M4 and the signal transmitted from the first switching transistor M1, and when the second end of the storage capacitor Cst is in a floating state, the voltage difference across the capacitor can be kept stable to couple the signal at the first end to the second end due to bootstrap of the capacitor.

Further, in order to reduce signal terminals, lower the difficulty of signal transmission wiring and reduce the occupied space, in the pixel compensation circuit according to some embodiments of the present disclosure, the conduction control signal terminal SC and the scan signal terminal SCAN may be the same signal terminal. For example, as shown in FIGS. 3*a* and 3*b*, the control electrode of the second switching transistor M2 is connected to the scan signal terminal SCAN. In addition, the second switching transistor M2 is opposite in type to the third switching transistor M3. As shown in FIG. 3*a*, the third switching transistor M3 is a P-type transistor, and the second switching transistor M2 is an N-type transistor. Alternatively, as shown in FIG. 3*b*, the third switching transistor M3 may be an N-type transistor, and the second switching transistor M2 may be a P-type transistor, which is not limited herein.

In the pixel compensation circuit of some embodiments according to the present disclosure, as shown in FIGS. 2*a* to 3*b*, the reset sub-circuit 5 may include: a fifth switching transistor M5 and a stabilization capacitance C0 (i.e., a second capacitor);

a control electrode of the fifth switching transistor M5 is connected to the reverse bias control signal terminal SN, a first electrode of the fifth switching transistor M5 is connected to the reverse bias voltage signal terminal VI, and a second electrode of the fifth switching transistor M5 is connected to the light emitting sub-circuit 4 and a first end of the stabilization capacitance C0; a second end of the stabilization capacitance C0 is connected to the second power terminal VSS. For example, the second electrode of the fifth switching transistor M5 and the first end of the stabilization capacitance C0 are connected to the anode of the electroluminescent device L in the light emitting sub-circuit 4 respectively.

In the pixel compensation circuit of some embodiments according to the present disclosure, as shown in FIG. 2*a*, the fifth switching transistor M5 may be a P-type transistor. Alternatively, the fifth switching transistor may also be N-type transistor, which is not limited herein.

In the pixel compensation circuit according to some embodiments of the present disclosure, when the fifth switching transistor M5 is in an ON state under the control of a signal at the reverse bias control signal terminal SN, a signal at the reverse bias voltage signal terminal VI may be transmitted to the anode of the electroluminescent device L in the light emitting sub-circuit 4, so that the electroluminescent device L is set to a reverse-biased state to prevent the electroluminescent device L from being always in a forward-biased state, thereby the performance and lifetime of the electroluminescent device L can be improved. The stabilization capacitance C0 can keep the voltage difference between the light emitting sub-circuit 4 and the second power terminal VSS stable, that is, to maintain the stable reverse bias between the anode and the cathode of the electroluminescent device L.

In a pixel compensation circuit according to some embodiments of the present disclosure, a voltage of the signal at the reverse bias voltage signal terminal VI is smaller than a voltage of the signal at the second power terminal VSS at least during a period in which the fifth switching transistor M5 is turned on. Wherein, the signal at the reverse bias voltage signal terminal VI may be a constant voltage signal. Alternatively, the signal of the reverse bias voltage signal terminal VI may also be a pulse signal. In a practical application, the voltage of the signal at the reverse bias voltage signal terminal VI and the voltage of the signal at the second power terminal VSS need to be determined according to the actual application environments, which is not limited herein.

Further, in order to reduce signal terminals, lower the degree of difficulty of signal transmission wiring and reduce the occupied space, in the pixel compensation circuit according to some embodiments of the present disclosure, the reverse bias control signal terminal SN and the reverse bias voltage signal terminal VI may be the same signal terminal.

For example, as shown in FIGS. 2*b*, 3*a* and 3*b*, the first electrode and the control electrode of the fifth switching transistor M5 are both connected to the reverse bias control signal terminal SN. Besides, the fifth switching transistor M5 is a P-type transistor.

Furthermore, in the above pixel compensation circuit of some embodiments according to the present disclosure, as shown in FIGS. 2*a* and 2*b*, all the transistors may be P-type transistors. This allows unified processes of the various transistors in the pixel compensation circuit, and thereby simplifying the manufacturing process.

In a pixel compensation circuit according to some embodiments of the present disclosure, P-type transistors are turned off by a high-potential signal, and are turned on by a low-potential signal; N-type transistors are turned on by a high-potential signal, and are turned off by a low-potential signal.

It should be noted that, in the above pixel compensation circuit provided by the embodiments of the present disclosure, the driving transistor and the various switching transistors may be thin film transistors (TFT) or metal oxide semiconductor field effect transistors (MOS), which is not limited herein. The control electrode of each switching transistor serves as its gate electrode, and for each switching transistor, depending on its type and the signal at the signal terminal, the first electrode can be taken as its source electrode and the second electrode as its drain electrode, or on the contrary, the first electrode may be taken as its drain electrode and the second electrode as its source electrode, which is not limited herein.

The working process of the above pixel compensation circuit provided by the embodiment of the present disclosure will be described below in conjunction with a circuit timing diagram. In the following description, "1" indicates a high potential, and "0" indicates a low potential. It should be noted that "1" and "0" are logic potentials, which are only used to explain the specific working process of the embodiment of the present disclosure better, and are not voltages applied to the gate electrodes of the respective switching transistors in the specific implementation.

Figure 4A:
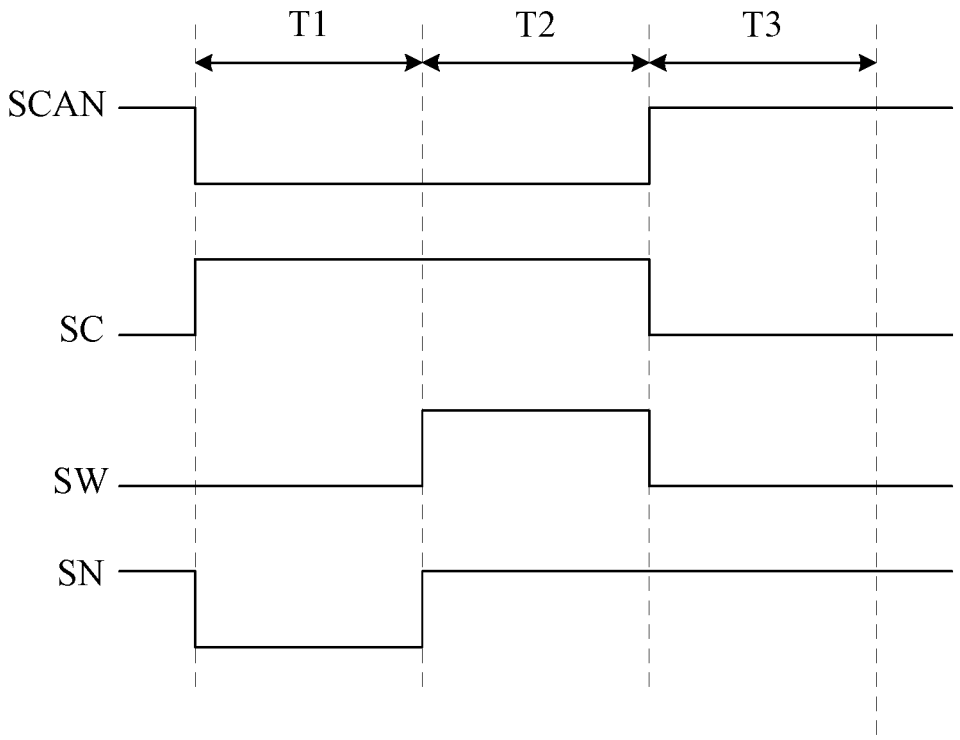
FIG. 4*a* is a timing diagram of the pixel compensation circuit according to an embodiment of the present disclosure.

Taking the structure of the pixel compensation circuit shown in FIG. 2*b* as an example, its corresponding circuit timing diagram is shown in FIG. 4*a*. Specifically, three stages of reset stage T1, threshold compensation stage T2, and light emitting stage T3 in the timing diagram shown in FIG. 4*a* are selected.

In reset stage T1, SCAN=0, SC=1, SW=0, SN=0. Since SCAN=0, both of the third switching transistor M3 and the fourth switching transistor M4 are turned on. The turned-on third switching transistor M3 inputs the data signal at the data signal terminal DATA to the control electrode of the driving transistor M0, such that the voltage of the control electrode of the driving transistor M0 is the voltage $V_{data}$ of the data signal. The turned-on fourth switching transistor M4 transmits a signal at the reference voltage signal terminal VREF to the second end of the storage capacitor Cst, such that the voltage of the second end of the storage capacitor Cst is to the voltage $V_{ref}$ of the signal of the reference voltage signal terminal VREF. Since SW=0, the first switching transistor M1 is turned on and transmits a signal at the second power terminal VDD to the first electrode of the driving transistor M0 and the first end of the storage capacitor Cst, so that both of the voltage of the first electrode of the driving transistor M0 and the voltage of the first end of the storage capacitor Cst are the voltage $V_{dd}$ of the signal at the first power terminal VDD, and thus the storage capacitor Cst is charged, as a result the voltage difference across the storage capacitor Cst is: $V_{dd}-V_{ref}$. Since SN=0, the fifth switching transistor M5 is turned on to transmit the signal at the reverse bias control signal terminal SN to the anode of the electroluminescent device L, so that the electroluminescent device L is in a reverse bias state, which may improve the performance and lifetime of the electroluminescent device L. Since SC=1, the second switching transistor M2 is turned off.

In threshold compensation stage T2, SCAN=0, SC=1, SW=1, SN=1. Since SCAN=0, both of the third switching transistor M3 and the fourth switching transistor M4 are turned on. The turned-on third switching transistor M3 inputs the data signal at the data signal terminal DATA to the control electrode of the driving transistor M0, such that the voltage of the control electrode of the driving transistor M0 is the voltage $V_{data}$ of the data signal. The turned-on fourth switching transistor M4 transmits a signal at the reference voltage signal terminal VREF to the second end of the storage capacitor Cst, such that the voltage of the second end of the storage capacitor Cst is the voltage $V_{ref}$ of the signal of the reference voltage signal terminal VREF. Since SW=1, the first switching transistor M1 is turned off. Due to the action of the storage capacitor Cst, the voltage of its first end can be maintained at $V_{dd}$ for a certain period of time, so that the driving transistor M0 is turned on by its gate-source voltage, so that the voltage $V_{dd}$ is discharged through the driving transistor M0 until the voltage of the first electrode of the driving transistor M0 becomes $V_{data}+|V_{th}|$, and the driving transistor M0 is turned off. At this time, the voltage difference across the storage capacitor Cst is: $V_{data}+|V_{th}|-V_{ref}$. Since SC=1, the second switching transistor M2 is turned off. Since SN=1, the fifth switching transistor M5 is turned off.

In light emitting stage T3, SCAN=1, SC=0, SW=0, SN=1. Since SN=1, the fifth switching transistor M5 is turned off, it is possible to avoid affecting the light emitting of the electroluminescent device L. Since SC=0, the second switching transistor M2 is turned on to connect the second end of the storage capacitor Cst to the control electrode of the driving transistor M0. Since SW=0, the first switching transistor M1 is turned on and transmits a signal at the second power terminal VDD to the first electrode of the driving transistor M0 and the first end of the storage capacitor Cst, so that both of the voltage of the first electrode of the driving transistor M0 and the voltage of the first end of the storage capacitor Cst are the voltage $V_{dd}$, since the second end of the storage capacitor Cst is in a floating state, due to bootstrap of the storage capacitor Cst, the voltage of the second end of the storage capacitor Cst becomes: $V_{dd}-V_{data}-|V_{th}|+V_{ref}$, that is, the voltage of the first electrode of the driving transistor M0 becomes $V_{dd}-V_{data}-|V_{th}|+V_{ref}$. According to current characteristic of the driving transistor M0 at saturation state, the driving current $I_L$ flowing through the driving transistor M0 and used to drive the light emitting device L to emit light satisfies the following formula:

$$I_L=K(V_{gs}+|V_{th}|)^2=K[V_{dd}-V_{data}-|V_{th}|+V_{ref}-V_{dd}+|V_{th}|]^2=K(V_{ref}-V\text{data})^2;$$

wherein Vgs is the gate-source voltage of the driving transistor M0; K is a structural parameter and $$K=\frac{1}{2}\mu C_{ox}\frac{W}{L};$$

wherein, $C_{ox}$ is the channel capacitance of the driving transistor M0, μ is the channel mobility of the driving transistor M0, W is the channel width of the driving transistor M0, L is the channel length of the driving transistor M0, the values of $C_{ox}$, μ, W and L in the same structure are relatively stable, thus the value of K is relatively stable and can be treated as a constant. It can be seen from the above formula that the driving current $I_L$ is only related to the voltage $V_{ref}$ of the reference voltage signal terminal VREF and the voltage $V_{data}$ of the data signal terminal DATA, and is independent of the threshold voltage $V_{th}$ of the driving transistor M0 and the voltage $V_{dd}$ of the second power terminal VDD, threshold voltage $V_{th}$ drift due to the manufacturing process of the driving transistor M0 and its long-time operation, and the influence of the IR drop on the current flowing through the electroluminescent device L can be addressed, thereby stabilizing the driving current of the electroluminescent device L, and further guaranteeing the normal operation of the electroluminescent device L.

In the above-described embodiment, the first switching transistor M1 is turned on in the reset stage, so that the storage capacitor Cst is directly charged by the first power terminal VDD, the driving transistor M0 is controlled to be turned on in the compensation stage to discharge the storage capacitor Cst to write the voltage of the data signal DATA and the threshold voltage of the driving transistor M0 to the first electrode of the driving transistor M0 and the storage capacitor Cst, thereby the charging time is shortened compared with charging the capacitor by a data signal in the prior art, so that the problem of a longer charging time caused by a smaller current in the case of a low gray scale data signal can be effectively overcome, and the stability of light emitting and display can be improved. In addition, in reset stage, the fifth switching transistor M5 is turned on, so that the electroluminescent device L is controlled to be in a reverse bias state, which may improve the performance and lifetime of the electroluminescent device L.

Figure 4B:
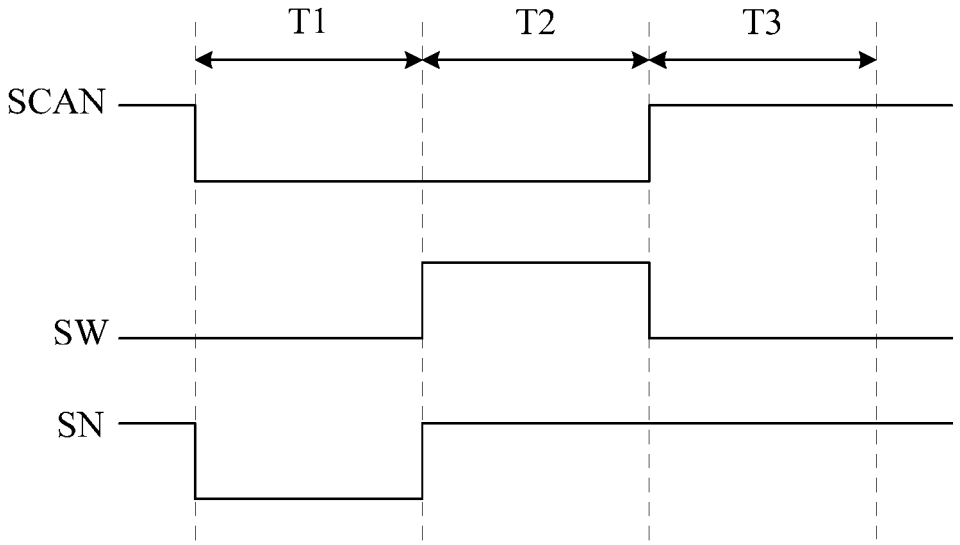
FIG. 4*b* is a timing diagram of the pixel compensation circuit according to an embodiment of the present disclosure.

The pixel compensation circuit shown in FIG. 3*a*, which is based on the pixel compensation circuit shown in FIG. 2*b*, uses the signal at the scan signal terminal SCAN to control the second switching transistor M2, in which the second switching transistor M2 is a N-type transistor, both of the third switching transistor M3 and the fourth switching transistor M4 are P-type transistors. FIG. 4*b* shows a corresponding circuit timing diagram thereof. For example, three stages of reset stage T1, threshold compensation stage T2, and light emitting stage T3 in the timing diagram shown in FIG. 4*b* are selected.

In reset stage T1, SCAN=0, SW=0, SN=0. In this stage, since SCAN=0, the second switching transistor M2 is turned off. The rest of the working process in this stage is substantially the same as the working process of the reset stage T1 in the embodiment shown in FIG. 2*b*, and will not be described in detail herein.

In threshold compensation stage T2, SCAN=0, SW=1, SN=1. In this stage, since SCAN=0, the second switching transistor M2 is turned off. The rest of the working process in this stage is substantially the same as the working process of the compensation stage T2 in the embodiment shown in FIG. 2*b*, and will not be described in detail herein.

In light emitting stage T3, SCAN=1, SW=0, SN=1. In this stage, since SCAN=1, the second switching transistor M2 is turned on. The rest of the working process in this stage is substantially the same as the working process of the reset stage T3 in the embodiment shown in FIG. 2*b*, and will not be described in detail herein.

Figure 4C:
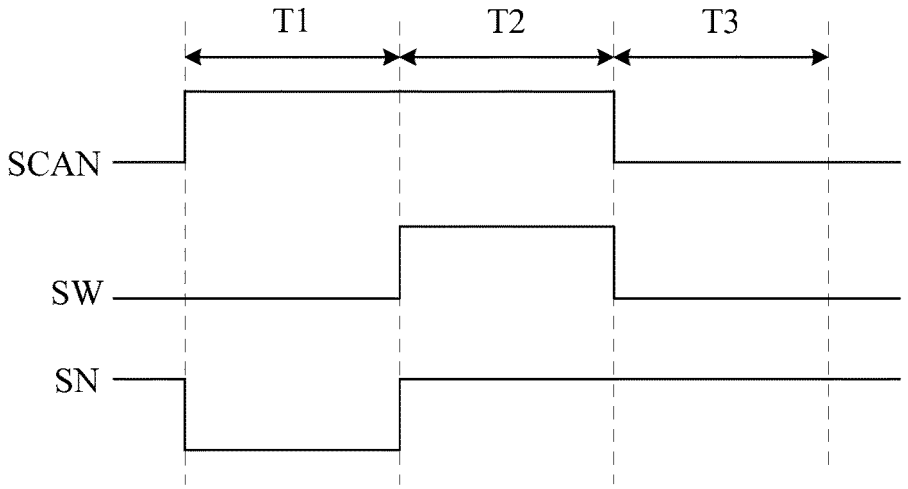
FIG. 4*c* is a timing diagram of the pixel compensation circuit according to an embodiment of the present disclosure.

The pixel compensation circuit shown in FIG. 3*b*, which is based on the pixel compensation circuit shown in FIG. 3*a*, uses a P-type transistor as the second switching transistor M2, and both of the third switching transistor M3 and the fourth switching transistor M4 are N-type transistors. FIG. 4*c* shows a corresponding circuit timing diagram thereof. For example, three stages of reset stage T1, threshold compensation stage T2, and light emitting stage T3 in the timing diagram shown in FIG. 4*c* are selected.

In reset stage T1, SCAN=1, SW=0, SN=0. In this stage, since SCAN=1, both of the third switching transistor M3 and the fourth switching transistor M4 are turned on, and the second switching transistor M2 is turned off. The rest of the working process in this stage is substantially the same as the working process of the reset stage T1 in the embodiment shown in FIG. 2*b*, and will not be described in detail herein.

In threshold compensation stage T2, SCAN=1, SW=1, SN=1. In this stage, since SCAN=1, both of the third switching transistor M3 and the fourth switching transistor M4 are turned on, and the second switching transistor M2 is turned off. The rest of the working process in this stage is substantially the same as the working process of the compensation stage T2 in the embodiment shown in FIG. 2*b*, and will not be described in detail herein.

In light emitting stage T3, SCAN=0, SW=0, SN=1. In this stage, since SCAN=0, both of the third switching transistor M3 and the fourth switching transistor M4 are turned off, and the second switching transistor M2 is turned on. The rest of the working process in this stage is substantially the same as the working process of the reset stage T3 in the embodiment shown in FIG. 2*b*, and will not be described in detail herein.

Figure 5:
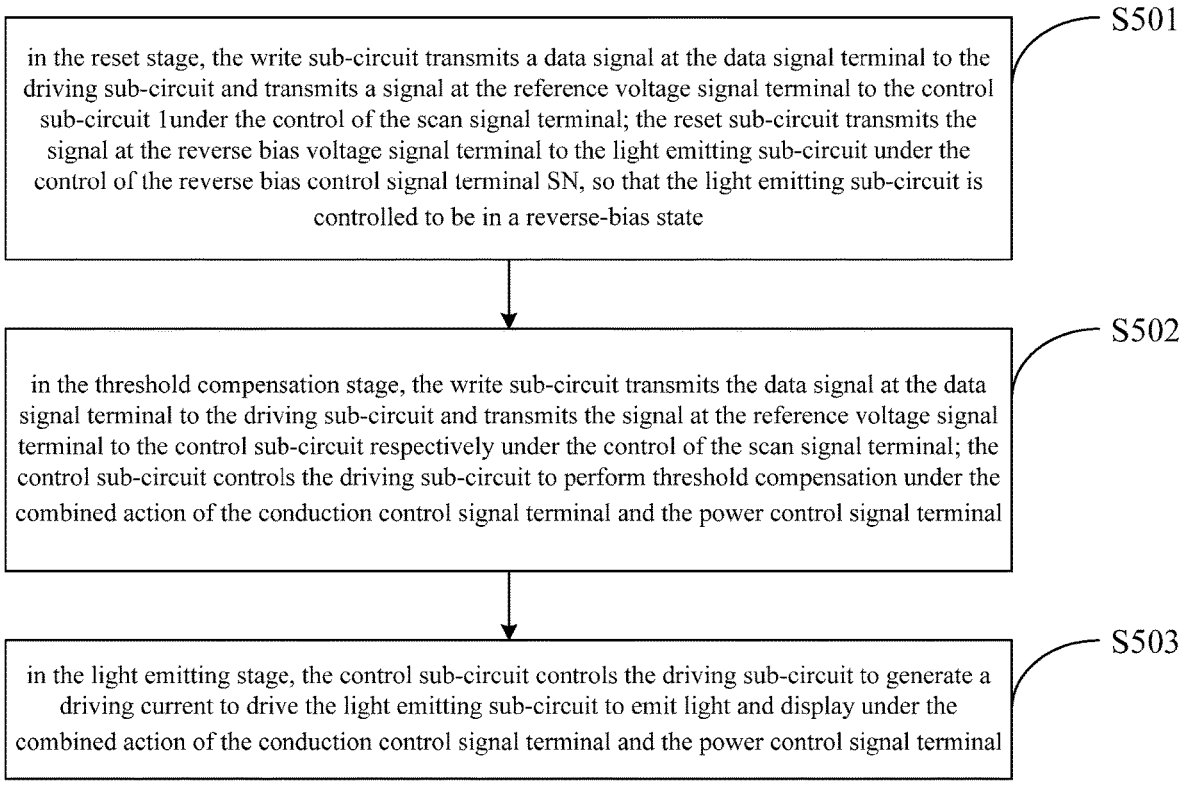
FIG. 5 is a flowchart of a driving method according to an embodiment of the present disclosure.

Based on the same inventive concept, an embodiment of the present disclosure further provides a method for driving any of the above pixel compensation circuits, as shown in FIG. 5, including: a reset stage, a threshold compensation stage and a light emitting stage.

S501, in the reset stage, the write sub-circuit 2, under the control of the scan signal terminal SCAN, transmits a data signal at the data signal terminal DATA to the driving sub-circuit 3, and transmits a signal at the reference voltage signal terminal VREF to the control sub-circuit 1; the reset sub-circuit 5, under the control of the reverse bias control signal terminal SN, transmits the signal at the reverse bias voltage signal terminal VI to the light emitting sub-circuit 4, so that the light emitting sub-circuit 4 is controlled to be in a reverse-bias state.

S502, in the threshold compensation stage, the write sub-circuit 2, under the control of the scan signal terminal SCAN, transmits the data signal at the data signal terminal DATA to the driving sub-circuit 3 and transmits the signal at the reference voltage signal terminal VREF to the control sub-circuit 1 respectively; the control sub-circuit 1 controls the driving sub-circuit 3 to perform threshold compensation under the combined action of the conduction control signal terminal SC and the power control signal terminal SW;

S503, in the light emitting stage, the control sub-circuit 1, under the combined action of the conduction control signal terminal SC and the power control signal terminal SW, controls the driving sub-circuit 3 to generate a driving current to drive the light emitting sub-circuit 4 to emit light and display.

In the driving method provided in the embodiment of the present disclosure, through charging and discharging the pixel compensation circuit by the signal at the first power terminal VDD, the function of quickly writing the threshold voltage of the driving transistor M0 can be realized, so that the pixel compensation circuit is enabled to perform fast threshold voltage compensation and reduce the compensation charging time, thereby further improving light emitting and display stability. In addition, the light emitting sub-circuit 4 may be reset and the light emitting sub-circuit 4 is controlled to be in a reverse bias state, which may further improve a problem of reduced performance and lifetime of the light emitting sub-circuit 4 due to the loss caused by long time forward biasing.

Based on the same inventive concept, a display panel is further provided in an embodiment of the present disclosure, which includes any one of the above pixel compensation circuits provided in the embodiments of the present disclosure. The principle of the solution of the display panel is similar to that of the pixel compensation circuit described above. Therefore, reference can be made to the implementation of the pixel compensation circuit described above for the implementation of the display panel, which will not be repeated herein.

The display panel provided in the embodiment of the present disclosure may be an organic light emitting display panel, or may be a quantum dot light emitting display panel, which is not limited herein.

Based on the same inventive concept, a display device is further provided in an embodiment of the present disclosure, which includes the display panel provided in the embodiment of the present disclosure. The display device may be a mobile phone, a tablet computer, a TV, a display, a notebook computer, a digital frame, a navigator or any other product or component having display function. As understood by the present disclosure, the display device has other indispensable components, which will not be described in detail herein, and should not be construed as limitation on the disclosure. For the implementation of the display device, reference may be made to the embodiment of above-described pixel compensation circuit, and its repeated description will be omitted herein.

In the pixel compensation circuit and its driving method, display panel and display device provided in the embodiments of the present disclosure, through charging the pixel compensation circuit by the signal at the first power terminal VDD, the function of quickly writing the threshold voltage of the driving transistor M0 can be realized, so that the pixel compensation circuit is enabled to perform fast threshold voltage compensation and reduce the compensation charging time, thereby further improving light emitting and display stability. Besides, the reset sub-circuit 5 transmits the signal at the reverse bias voltage signal terminal VI to the light emitting sub-circuit 4 under the control of the reverse bias control signal terminal SN, the light emitting sub-circuit 4 is reset and the light emitting sub-circuit 4 is controlled to be in a reverse bias state, which may further improve a problem of reduced performance and lifetime of the light emitting sub-circuit 4 due to the loss caused by long time forward biasing.

It will be apparent to those skilled in the art that various modifications and variations can be made to the embodiments of the present disclosure without departing from the spirit or scope of the present disclosure. In this case, if the modifications and variations made to the present disclosure fall within the scope of the claims of the present disclosure and equivalents thereof, the present disclosure is intended to comprise the modifications and variations.

The invention claimed is:

1. A pixel compensation circuit, including: a control sub-circuit, a write sub-circuit, a driving sub-circuit, a light emitting sub-circuit, and a reset sub-circuit, wherein the write sub-circuit is configured to, in a reset stage and a threshold compensation stage, under the control of a scan signal terminal, transmit a data signal at a data signal terminal to the driving sub-circuit and transmit a signal at a reference voltage signal terminal to the control sub-circuit;

the control sub-circuit is configured to, in the reset stage, under the control of a power control signal terminal, transmit a signal at a first power terminal to the driving sub-circuit, and in the threshold compensation stage, under the combined action of a conduction control signal terminal and the power control signal terminal, control the driving sub-circuit to perform threshold compensation, and in a light emitting stage, under the combined action of a conduction control signal terminal and the power control signal terminal, control the driving sub-circuit to generate a driving current to drive the light emitting sub-circuit to emit light;

the reset sub-circuit is configured to, in the reset stage, under the control of a reverse bias control signal terminal, transmit a signal at the reverse bias voltage signal terminal to the light emitting sub-circuit;

the driving sub-circuit comprises a driving transistor; wherein a control electrode of the driving transistor is connected to the control sub-circuit and the write sub-circuit respectively, a first electrode of the driving transistor is connected to the control sub-circuit, and a second electrode of the driving transistor is connected to the light emitting sub-circuit;

the light emitting sub-circuit comprises an electroluminescent device; wherein an anode of the electroluminescent device is connected to the driving sub-circuit and the second electrode of the fifth transistor, and a cathode of the electroluminescent device is connected to the second power terminal;

the control sub-circuit comprises: a first switching transistor, a second switching transistor, and a first capacitor; a control electrode of the first switching transistor is connected to the power control signal terminal, a first electrode of the first switching transistor is connected to the first power terminal, and a second electrode of the first switching transistor is connected to a first end of the first capacitor and the driving sub-circuit respectively; a control electrode of the second switching transistor is connected to the conduction control signal terminal, a first electrode of the second switching transistor is connected to a second end of the first capacitor and the write sub-circuit respectively, a second electrode of the second switching transistor is connected to the driving sub-circuit; and the reset sub-circuit includes a fifth switching transistor and a second capacitor; a control electrode of the fifth switching transistor is connected to the reverse bias control signal terminal, a first electrode of the fifth switching transistor is connected to the reverse bias voltage signal terminal, and a second electrode of the fifth switching transistor is connected to the anode of the electroluminescent device and a first end of the second capacitor; a second end of the second capacitor is connected to a second power terminal.

2. The pixel compensation circuit according to claim 1, wherein the write sub-circuit comprises: a third switching transistor and a fourth switching transistor;

a control electrode of the third switching transistor is connected to the scan signal terminal, a first electrode of the third switching transistor is connected to the data signal terminal, and a second electrode of the third switching transistor is connected to the driving sub-circuit;

a control electrode of the fourth switching transistor is connected to the scan signal terminal, a first electrode of the fourth switching transistor is connected to the reference voltage signal terminal, and a second electrode of the fourth switching transistor is connected to the control sub-circuit.

3. The pixel compensation circuit according to claim 1, wherein the reverse bias control signal terminal and the reverse bias voltage signal terminal are the same signal terminal.

4. The pixel compensation circuit according to claim 3, wherein the fifth switching transistor is a P-type transistor.

5. The pixel compensation circuit according to claim 1, wherein a signal voltage at the reverse bias voltage signal terminal is smaller than a signal voltage at the second power terminal at least during a period in which the fifth switching transistor is turned on.

6. The pixel compensation circuit according to claim 1, wherein the driving transistor is a P-type transistor.

7. The pixel compensation circuit according to claim 1, wherein the electroluminescent device is an organic light emitting diode or a quantum dot light emitting diode.

8. The pixel compensation circuit according to claim 1, wherein the conduction control signal terminal and the scan signal terminal are the same signal terminal.

9. The pixel compensation circuit according to claim 1, wherein the reference voltage signal terminal and the second power terminal are the same signal terminal.

10. A display panel, comprising the pixel compensation circuit according to claim 1.

11. A display device, comprising the display panel according to claim 10.

12. A method for driving a pixel compensation circuit of claim 1, including:

in the reset stage, the write sub-circuit transmitting, under the control of the scan signal terminal, the data signal at the data signal terminal to the driving sub-circuit, and transmitting the signal at the reference voltage signal terminal to the control sub-circuit;

in the threshold compensation stage, the write sub-circuit transmitting, under the control of the scan signal terminal, the data signal at the data signal terminal to the driving sub-circuit, and transmitting the signal at the reference voltage signal terminal to the control sub-circuit; the control sub-circuit controlling, under the combined action of the conduction control signal terminal and the power control signal terminal, the driving sub-circuit to perform threshold compensation;

in the light emitting stage, the control sub-circuit controlling, under the combined action of the conduction control signal terminal and the power control signal terminal, the driving sub-circuit to generate the driving current to drive the light emitting sub-circuit to emit light and display.

13. The method according to claim 12, wherein in the reset stage, the reset sub-circuit transmits, under the control of the reverse bias control signal terminal, a signal at the reverse bias voltage signal terminal to the light emitting sub-circuit, so that the light emitting sub-circuit is controlled to be in a reverse bias state.

* * * * *